United States Patent [19]

Falchetti

[11] Patent Number: 4,815,993

[45] Date of Patent: Mar. 28, 1989

[54] FUSE CARRIER PARTICULARLY FOR VEHICLES

[75] Inventor: Umberto Falchetti, Codogno, Italy

[73] Assignee: Meccanotecnica Codognese S.p.A., Codogno, Italy

[21] Appl. No.: 87,178

[22] Filed: Aug. 19, 1987

[30] Foreign Application Priority Data

Nov. 17, 1986 [IT] Italy ..... 22356 A/86

[51] Int. Cl.[4] ..... H01R 13/68

[52] U.S. Cl. ..... 439/622; 439/490; 337/242; 340/638

[58] Field of Search ..... 337/241, 242, 265, 266; 340/638, 639, 641; 439/488–490, 621, 622, 698

[56] References Cited

U.S. PATENT DOCUMENTS

| | | | |
|---|---|---|---|
| 852,539 | 5/1907 | Buchanan | 340/638 |
| 1,641,203 | 9/1927 | Scordamaglia | 337/242 |
| 1,902,804 | 3/1933 | La Mar | 337/242 |
| 2,321,271 | 6/1943 | Bahlke et al. | 337/241 |
| 4,238,140 | 12/1980 | Cairns et al. | 439/621 |
| 4,499,447 | 2/1985 | Greenberg | 337/241 |
| 4,556,274 | 12/1985 | Olivera | 439/621 |
| 4,695,107 | 9/1987 | Leppert | 439/488 |
| 4,695,815 | 9/1987 | Hwang | 439/488 |

*Primary Examiner*—Gil Weidenfeld
*Assistant Examiner*—Gary F. Paumen
*Attorney, Agent, or Firm*—Butler & Binion

[57] ABSTRACT

A fuse carrier comprises a plurality of sockets for reed-type fuses, each socket being provided with a pair of electrode clips adapted to provide support and electrical connection for each fuse. The electrode clips configured to accommodate a microlamp which is connected in parallel to the fuse. The lamp therefore illuminates whenever the fuse burns out.

6 Claims, 3 Drawing Sheets

FUSE CARRIER PARTICULARLY FOR VEHICLES

DESCRIPTION

This invention relates to a fuse carrier particularly, though not exclusively, for use on vehicles, being of a type which comprises pairs of electrode clips arranged to provide support and electric connection for corresponding fuses. Applicant herein cross-references U.S. Ser. No. 086,995 entitled "An Adapter Base for Reed-Type Fuses."

Fuse carriers of this type are widely employed on all kinds of vehicles, and specifically on passenger cars.

On passenger cars, moreover, the fuse carriers are mounted in out-of-view recesses which are not easily accessible.

This invention fills a well-recognized demand for greater convenience in locating and replacing burned out fuses.

In this respect, a recent prior proposal has been the expedient of using a so-called luminous type fuse. This conventional fuse comprises a pair of reeds between which a fuse filament and small lamp are held in parallel relationship.

This type of fuse, while substantially achieving its objective, has a serious drawback in that the lamp must be removed and discarded whenever the fuse must be replaced because of a burned out filament. This is a very costly procedure, given that the luminous fuse is far more expensive than a conventional one.

The technical problem underlying this invention is to devise and provide a fuse carrier which has such constructional and operational features as to obviate the cited drawbacks which affect the prior art.

This technical problem is solved by a fuse carrier of the type specified above being characterized in that it further comprises a lampholder for a microlamp connected electrically to each electrode pair.

Further features and the advantages of this invention will be more clearly understood from the following description of an exemplary embodiment thereof, given by way of illustration and not of limitation with reference to the accompanying drawing figures.

Figure 1:
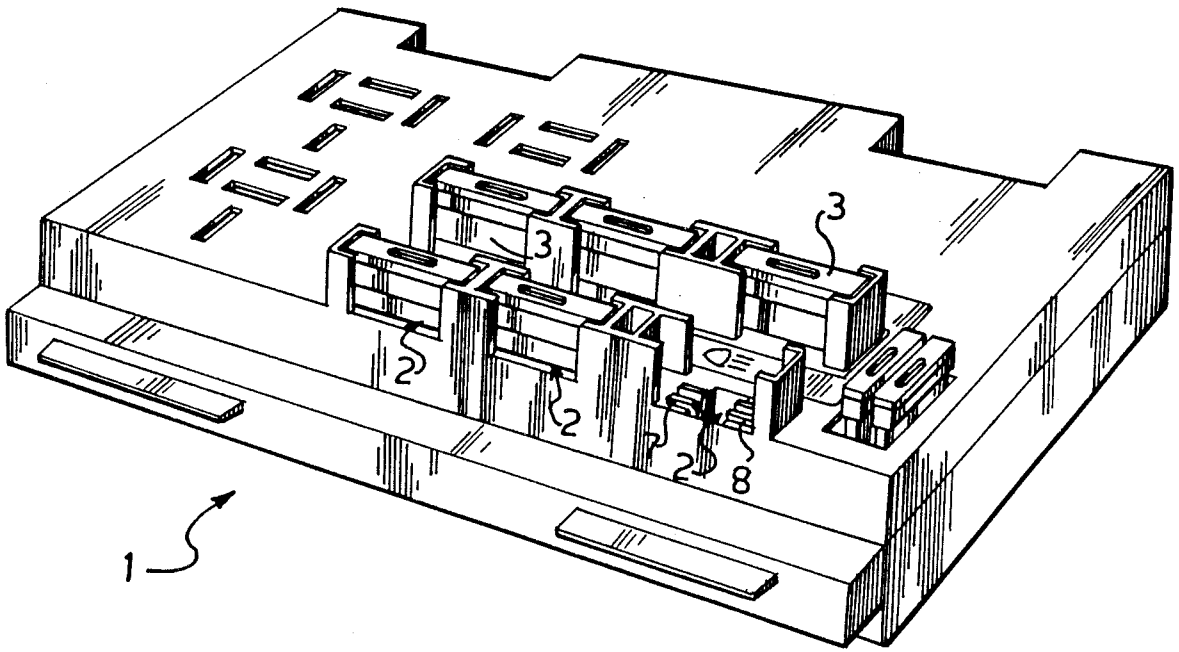
FIG. 1 is a perspective view of a fuse carrier according to the invention.
Figure 2:
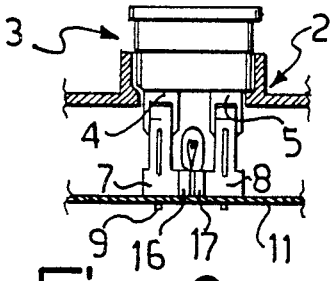
FIGS. 2 to 4 show respectively front, side, and perspective detail views of a first embodiment of the fuse carrier of FIG. 1.
Figure 4:
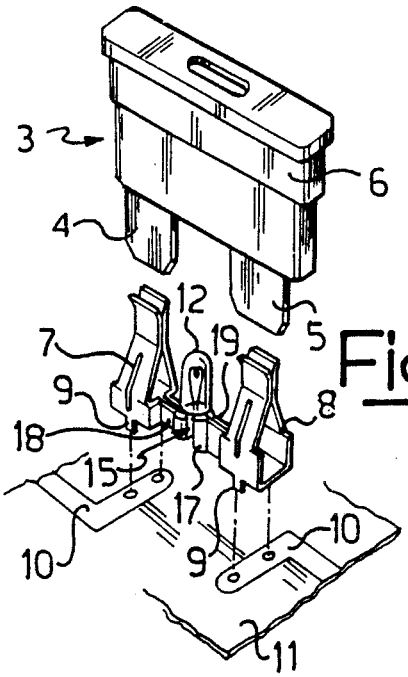
Figure 3:
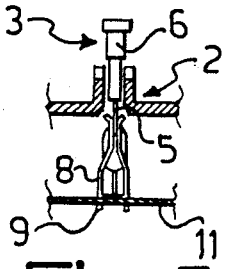

With reference to the drawing figures, generally indicated at 1 is a fuse carrier according to the invention which comprises a plurality of sockets 2 for fuses 3 of the so-called reed type.

Each reed fuse 3 is comprises conventionally a pair of parallel reeds 4 and 5 between which a fuse filament, not shown, is secured transversely; the reeds and filament are accommodated within a body 6 of a clear plastics synthetic material.

Each fuse 3 is supported in its respective socket 2 by a pair of clip electrodes 7 and 8 which are adapted to clinch on the fuse reeds 4 and 5, respectively. The clip electrodes 7 and 8 also form the electric connection for the fuse 3, and for this purpose, they are provided with pin terminals, indicated at 9, which are soldered to suitable electric connection paths 10 formed on a printed circuit 11 housed within the fuse carrier 1.

Of course, the paths 10 would conventionally connect each fuse 3 to a corresponding power supply circuit for an electrical apparatus of the vehicle to be protected against shorting.

Advantageously according to the invention, a lamp 12 is held between the clip electrodes 7 and 8, in axial alignment to the fuse 3. More specifically, the lamp 12 is a microlamp having a glass base and rheophores (electrical conductors), 13 and 14, for connection to the filament. The lamp 12 is supported between the clips 7 and 8 with its base fitted into a sleeve lampholder 15, which comprises a pair of half-rings 16 and 17 structurally independent of each other and being each attached to and supported by a corresponding arm 18 and 19 extending perpendicularly to the clip electrodes 7 and 8.

The clip electrodes 7 and 8, and corresponding arms 18 and 19 laid to support the half-rings 16 and 17 of the sleeve 15 define a lampholder for the microlamp 12, while also powering the rheophores 13 and 14 thereof.

Figure 7:
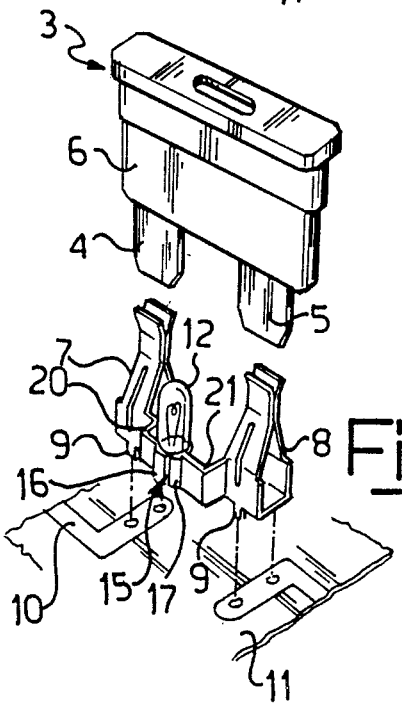
FIGS. 5 to 7 are respectively front, side, and prospective details views of a second embodiment of the fuse carrier of FIG. 1.
Figure 5:
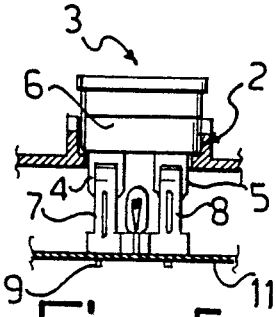
Figure 6:
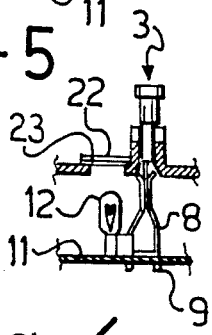
Figure 8:
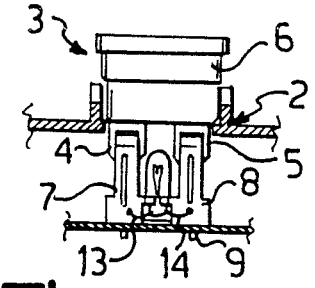
FIGS. 8 to 10 are respectively front, side, and perspective detail views of a third embodiment of the fuse carrier of FIG. 1.
Figure 10:
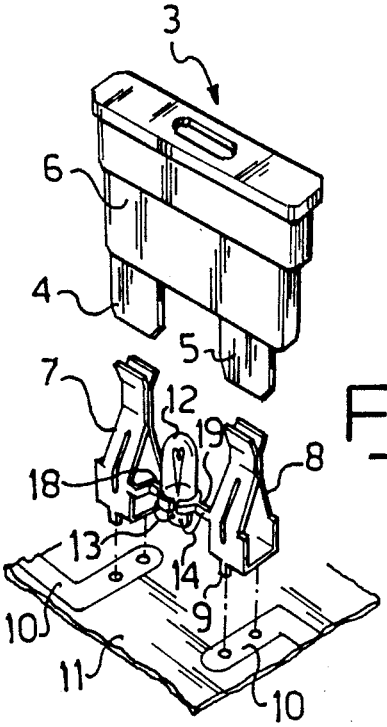
Figure 9:
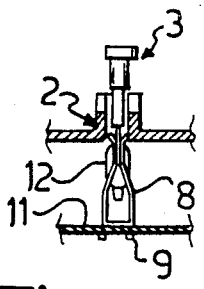
Figure 11:
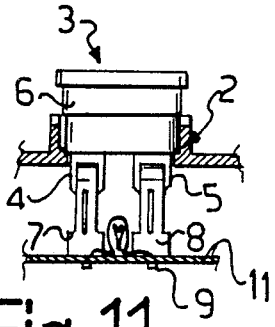
FIGS. 11 to 13 are respectively front, side, and perspective detail views of a further embodiment of the fuse carrier of FIG. 1.
Figure 13:
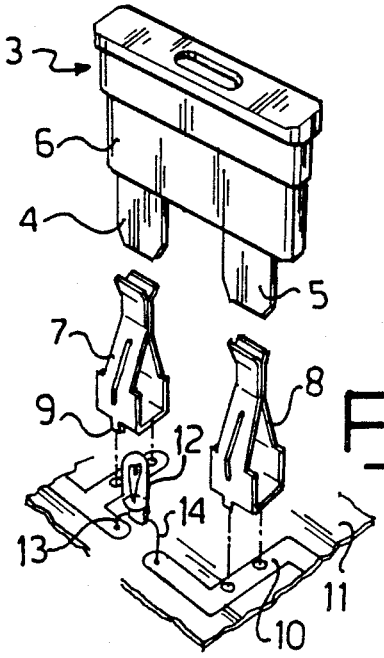
Figure 12:
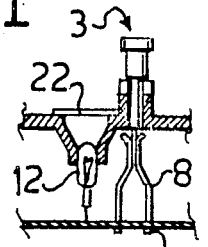

With particular reference to the example shown in FIG. 7, a second embodiment provides for the supporting arms, indicated at 20 and 21, of the sleeve 15 to be bent at right angles such that the sleeve 15 can be offset from the fuse 3. In this embodiment, this embodiment, the lamp 12 is carried laterally of the fuse 3 at a location underlying a window 22 imprinted with an ideogram 23 related generally to the kind of electrical apparatus being protected by that fuse.

In a third embodiment, the free lead rheophores 13 and 14 of the lamp 12 are soldered directly to the supporting arms 18 and 19 of the sleeve 15; and in a further embodiment, the rheophores 13 and 14 of a microlamp 12 are soldered directly to the paths 10 of the printed circuit 11.

Also in that further embodiment of the invention, the microlamp 12 would be secured to the paths 10 of the printed circuit 11 at a location underlying the window 22 which carries the ideogram 23 related to the circuit and electrical apparatus wherein the corresponding fuse is connected.

Understandably, it is within the scope of this invention that an exemplary embodiment thereof may include a plurality of lamps or light emitting diodes (LED) secured on the printed circuit 11 and being each parallel connected to a respective fuse such that the lamps, on the one side, and the fuses, on the other side, will correspond with one another by their number and order.

The fuse carrier of this invention affords the important advantage that, by virtue of the lamp being supported by and powered through the clip electrodes carrying the fuse, the lamp is structurally and operatively independent of the latter. Thus, in a burned out fuse filament situation, such as due to shorting, where the fuse is to be replaced, the indicator lamp will be turned on and facilitate its location.

Where instead the lamp is positioned in the fuse carrier to illuminate the ideogram associated with a fuse, the electrical apparatus affected by the short is also more easily located.

The cost of the fuse carrier according to the invention is comparable to that of conventional fuse carriers, and enables replacement of a burned out fuse while retaining its lamp. The fuse carrier of this invention, moreover, is apt to upgrade a vehicle equipped with it.

I claim:

1. A fuse carrier for reed-type fuses, particularly for use on vehicles, comprising:

a plurality of sockets for receiving the reed-type fuses; each of said plurality of sockets including a pair of electrode clips, said pair of electrode clips being arranged to receive a said reed-type fuse and to provide support and electrical connection to said reed-type fuse;

a lamp holder, supported between each said pair of electrode clips and electrically connected to said electrode clips; and a microlamp, positioned in said lamp holder;

wherein each electrode clip in said pair of electrode clips includes an arm unitary therewith which extends perpendicularly thereto toward the other electrode clip of said pair of electrode clips, said arm terminating in a half-ring section, with said half-ring section providing support for said microlamp.

2. A fuse carrier according to claim 1, wherein a first free lead wire is connected to one of said arms associated with one said electrode clip of said pair of electrode clips and to said microlamp, and a second free lead wire is connected to the other of said arms associated with the other said electrode clip of said pair of electrode clips and to said microlamp.

3. A fuse carrier for reed-type fuses, particularly for use on vehicles, comprising:

a plurality of sockets for receiving the reed-type fuses; each of said plurality of sockets including a pair of electrode clips, said pair of electrode clips being arranged to receive a said reed-type fuse and to provide support and electrical connection to said reed-type fuse;

said microlamp being mounted independently from said reed-type fuse on said printed circuit board and electrically connected to two said circuit paths; and each electrode clip of said pair of electrode clips is electrically connected to one of said individual circuit paths in such a manner as to electrically connect said microlamp in parallel with said reed-type fuse when said reed-type fuse is received in said pair of electrode clips.

4. A fuse carrier according to claim 3, wherein a first free lead wire is connected to one of said arms associated with each electrode clip of said pair of electrode clips and to said microlamp, and a second fuse lead wire is connected to the other of said arms associated with each electrode clip of said pair of electrode clips.

5. A fuse carrier for reed-type fuses, particularly for use on vehicles, comprising:

a plurality of sockets for receiving the reed-type fuses; each of said plurality of sockets including a pair of electrode clips, said pair of eletrode clips being arranged to receive a said reed-type fuse and to provide support and electrical connection to said reed-type fuse;

a lamp holder, supported between each said pair of electrode clips and electrically connected to said electrode clips; and a microlamp, positioned in said lamp holder; and further comprising a printed circuit board with individual circuit paths;

a lamp holder, supported between each said pair of electrode clips and electrically connected to said electrode clips; and a microlamp, positioned in said lamp holder;

wherein said fuse carrier includes a window with an ideogram, and each electrode clip of said pair of electrode clips includes an arm, unitary with each electrode clip, which is bent at a right angle with respect to said electrode clip;

said microlamp being supported by said arms which are integrally connected to each electrode clip of said pair of electrode clips, and said microlamp positioned at a location underlying said window associated with said fuse carrier.

6. A fuse carrier according to claim 5, wherein said fuse carrier includes a window with an ideogram, and said microlamp is positioned at a location underlying said window.

* * * * *